US005335599A

United States Patent [19]

Thiesen et al.

[11] Patent Number: 5,335,599

[45] Date of Patent: Aug. 9, 1994

[54] AMMUNITION UNIT

[75] Inventors: Stefan Thiesen, Erkrath; Eckhard Rahnenführer, Dormagen, both of Fed. Rep. of Germany

[73] Assignee: Rheinmetall GmbH, Dusseldorf, Fed. Rep. of Germany

[21] Appl. No.: 980,197

[22] Filed: Nov. 20, 1992

[30] Foreign Application Priority Data

Nov. 21, 1991 [DE] Fed. Rep. of Germany ..... 4138269

[51] Int. Cl.[5] ..... F42B 5/18; F42B 5/02

[52] U.S. Cl. ..... 102/431; 102/439; 102/443; 102/700

[58] Field of Search ..... 102/283, 285, 286, 287, 102/288, 430–433, 443, 700, 439

[56] References Cited

U.S. PATENT DOCUMENTS

| | | | |
|---|---|---|---|
| 751,519 | 2/1904 | Kilzer | 102/443 |
| 1,192,678 | 7/1916 | Patten | 102/286 |
| 3,734,020 | 5/1973 | Ciccone et al. | 102/430 |
| 4,770,099 | 9/1988 | Brede et al. | 102/472 |
| 4,876,962 | 10/1989 | Olsson | 102/288 |
| 4,911,077 | 3/1990 | Johannson et al. | 102/289 |
| 5,133,240 | 7/1992 | Thiesen et al. | 102/431 |
| 5,138,949 | 8/1992 | Swartout et al. | 102/431 |
| 5,179,250 | 1/1993 | Campoli | 102/443 |

FOREIGN PATENT DOCUMENTS

| | | | |
|---|---|---|---|
| 314547 | 5/1989 | European Pat. Off. | 102/443 |
| 4039149 | 6/1991 | Fed. Rep. of Germany | 102/443 |

*Primary Examiner*—Harold J. Tudor

*Attorney, Agent, or Firm*—Spencer, Frank & Schneider

[57] ABSTRACT

A performance enhanced ammunition unit composed of a front ammunition component (1) and a rear ammunition component (2) which each include a combustible propelling charge casing (7, 12), with the rear ammunition component being filled with propelling charge powder that has been compressed into a compressed member (15). The rear ammunition component (2) has a casing bottom (13) which accommodates a bottom igniter (14) and the compressed member (15) accommodates a combustible ignition tube (16) for the propelling charge igniter (16, 17), with the combustible tube 16 being in operative engagement with the bottom igniter (14) and extending along substantially the entire axis of the bottom component. Both ammunition components (1, 2) are separated by a combustible disk (18), the front ammunition member (1) is filled in its cylindrical section (8) filled with powder rods (10) and in its section (a) ahead of the powder rods with bulk propelling charge powder (11).

8 Claims, 2 Drawing Sheets

AMMUNITION UNIT

BACKGROUND OF THE INVENTION

The present invention relates to an ammunition unit of the type including a front ammunition component including a projectile that extends to the bottom of the ammunition component and a rear ammunition component including a casing bottom and a propelling charge igniter that extends axially essentially over the length of the rear ammunition component, with each of the two ammunition components including a combustible propelling charge casing. Still more particularly, the present invention relates to an ammunition unit of the above type wherein the front ammunition component is provided with a cylindrical charge casing section which is filled with propelling charge powder, the rear ammunition component is filled with propelling charge powder that has been compressed into a compressed member, and a supplemental charge is disposed, if required, in the region between the two ammunition components.

A two-part ammunition unit of the above type is disclosed in European Published application EP-OS 0,429,753 corresponding to U.S. Pat. No. 5,133,240. In this ammunition unit, a forward ammunition component accommodates a fin stabilized kinetic energy projectile in a propelling charge casing that is filled with bulk propelling charge powder, while the propelling charge casing of the adjacent rear ammunition component is filled with compressed propelling charge powder. A firing tube provided with openings is screwed into the casing bottom. The middle contact region between the two components is closed by a combustible covering disk. The total charge density that can be realized here is not particularly great if tail components of the projectile (propelling cage and guide mechanism) extend far into the cartridge, and therefore the rear ammunition component that is worked to hold the compressed propelling charge powder must be correspondingly small. Moreover, after a round has been fired, the ignition tube projects beyond the casing bottom while the propelling charge casings combust down to the casing bottom. Although it is possible that the front ammunition component may be filled, if required, with compressed propelling charge powder instead of bulk propelling charge powder, this is very expensive to produce.

Moreover, Federal Republic of Germany Laid-Open Patent application No. DE-OS 4,041,611, corresponding to allowed U.S. patent application 07/809,128, filed Dec. 8, 1991, discloses an ammunition unit in which a fin stabilized kinetic energy projectile including a propelling cage (sabot) is accommodated by a separate front ammunition component, with the fins of the projectile extending to the bottom of the front ammunition component. The latter accommodates tubular propelling charge powder in a propelling charge casing in the region of the fins, and bulk propelling charge powder in the region of the propelling cage (sabot). The separate rear ammunition component includes a propelling charge casing that is filled with bulk propelling charge powder in which a propelling charge igniter is disposed that extends axially over the length of the rear ammunition component. The resulting charge density is not particularly great.

In addition, Federal Republic of Germany Laid-Open patent application No. DE-OS 2,648,137 corresponding to U.S. Pat. No. 4,770,099 discloses a propelling charge igniter for ammunition in which a breech ring is provided that can be screwed into the casing bottom of an ammunition unit so as to accommodate a combustible firing tube for an ignition charge. However, such propelling charge igniters cannot be sufficiently secured in bulk propelling charge powder, so that they cannot ensure the formation of uniform gas pressure curves. Moreover, they may even break off, which would lead to safety risks.

European Patent No. 0,304,099, corresponding to U.S. Pat. No. 4,876,962 and European Patent No. 0,304,100, corresponding to U.S. Pat. No. 4,911,077 disclose a propelling charge comprising a bundle of densely packed tubes or rods of propelling charge powder (tubular powder) that extend practically over the entire length of the cartridge. The tubes or rods are provided with transverse slots and have axial channels as well as intended break locations. This bundle of tubes may be surrounded by bulk propelling charge powder. Drives made of such tube bundles do not realize the charge densities of a compacted charge.

SUMMARY OF THE INVENTION

It is an object of the present invention to provide an ammunition unit of the type initially described above which has a greater charge density and fires reliably (uniform gas pressure curves). Moreover, it has a combustible ignition chain so that the inner ballistic performance is increased correspondingly by easy means.

The above object is generally achieved according to the present invention by an ammunition unit which comprises: a front ammunition component including a combustible propelling charge casing having a rear cylindrical section and a front inwardly tapering section with a front opening, and a fin stabilized projectile having its rear fin component extending via said opening into the casing to the bottom of the first component; a rear ammunition component having a non-combustible casing bottom with a centrally disposed bottom igniter, a combustible propelling charge casing with a cylindrical section having a diameter corresponding to that of the cylindrical section of the front component fastened to the casing bottom, and a combustible ignition tube for a propelling charge igniter in operative engagement with the bottom igniter and extending axially essentially over the entire length of the rear ammunition component; a combustible disc separating the two ammunition components; a member of compressed propelling charge powder filling the propelling charge casing of the rear ammunition component and surrounding the ignition tube; rods of propelling charge powder extending longitudinally within and substantially filling the cylindrical section of the charge casing of the front ammunition component; and bulk propelling charge powder disposed in the inwardly tapering section of the front component in front of the powder rods.

According to preferred features of the invention, the powder rods form a ring surrounding the rear fin component of the projectile, and the bulk propelling charge powder is disposed in the interior of the ring adjacent the rear fin component of said projectile, and/or in the spaces between the powder rods.

The invention will be described below with reference to an embodiment of a kinetic energy ammunition unit.

DETAILED DESCRIPTION OF THE PREFERRED EMBODIMENT

Figure 1:
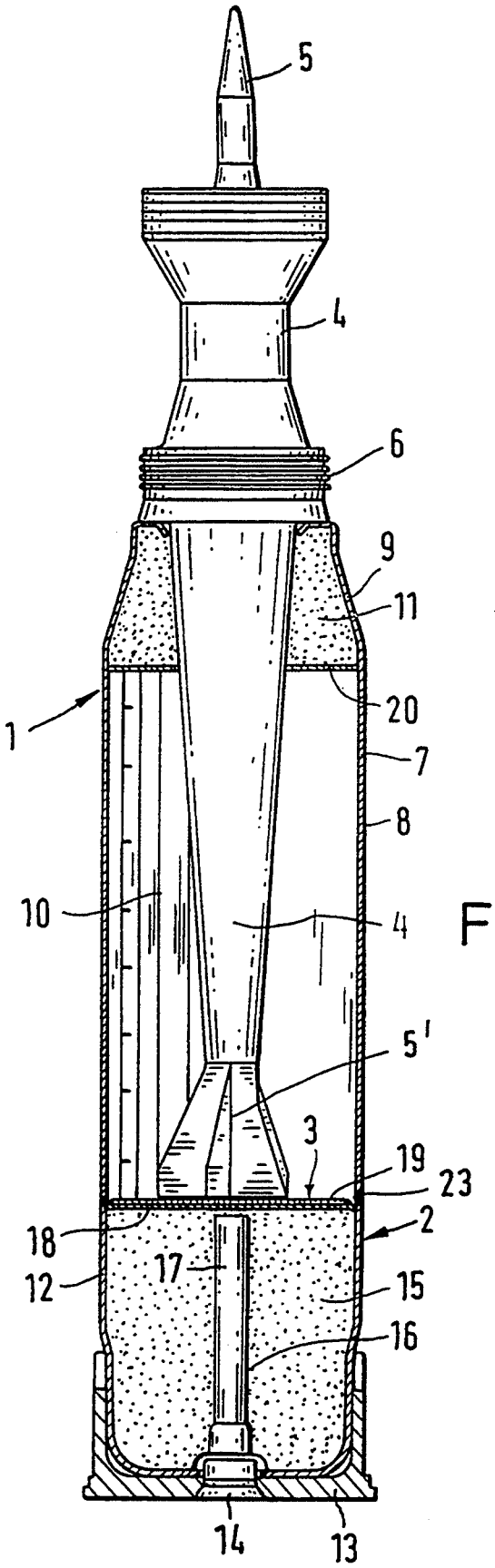
FIG. 1 is a side view, partially in longitudinal section, of a kinetic energy projectile ammunition unit according to the invention.

The ammunition unit illustrated in FIG. 1 includes a front ammunition component 1 and a rear ammunition component 2. The front ammunition component 1 accommodates a fin stabilized sub-caliber kinetic energy projectile 5 whose rear end fin assembly 5' extends to the bottom 3 of the front component 1, and which is provided with a propelling cage 4. The propelling cage 4 extends via a central opening into the front ammunition component 1 up to its sealing ring 6. The front ammunition component 1 includes a combustible propelling charge casing 7 which has a cylindrical section 8 and a front inwardly tapering shoulder 9 whose front end is turned inwardly until it comes to lie against the circumference of the propelling cage 4. The cylindrical section 8 of the propelling charge casing 7 is filled with powder rods 10 approximately as disclosed in European Patent Nos. 0,304,099 or European Patent No. 0,304,100, corresponding to U.S. Pat. No. 4,876,962 and U.S. Pat. No. 4,911,077, respectively. That is, cylindrical section 8 is filled with propelling charge powder that has been compressed into rods 10, which have possibly been provided with axial channels and transverse slots, with the rods 10 being arranged in a closely packed bundle that extends over the length of the cylindrical section 8. The interior of the charge casing of the front ammunition component 1 in the region of shoulder 9 is filled with bulk propelling charge powder 11, which may be varied in a simple manner in order to compensate for fluctuations in the powder lot.

Since appropriate lengths of the powder rods 10 are required in the region of the fins 5' and of the propelling cage 4, this creates large areas of dead space in the region of the tail of the projectile, so that the charge density in this region is low. A further increase in performance due to an increase int he overall charge density is realized if the power rods 10 are arranged in the form of a ring surrounding the projectile with the interior space of this ring adjacent to the fins 5' and the propelling cage 4 being filled with bulk propelling charge powder. This additionally simplifies working of the front component.

Figure 2:
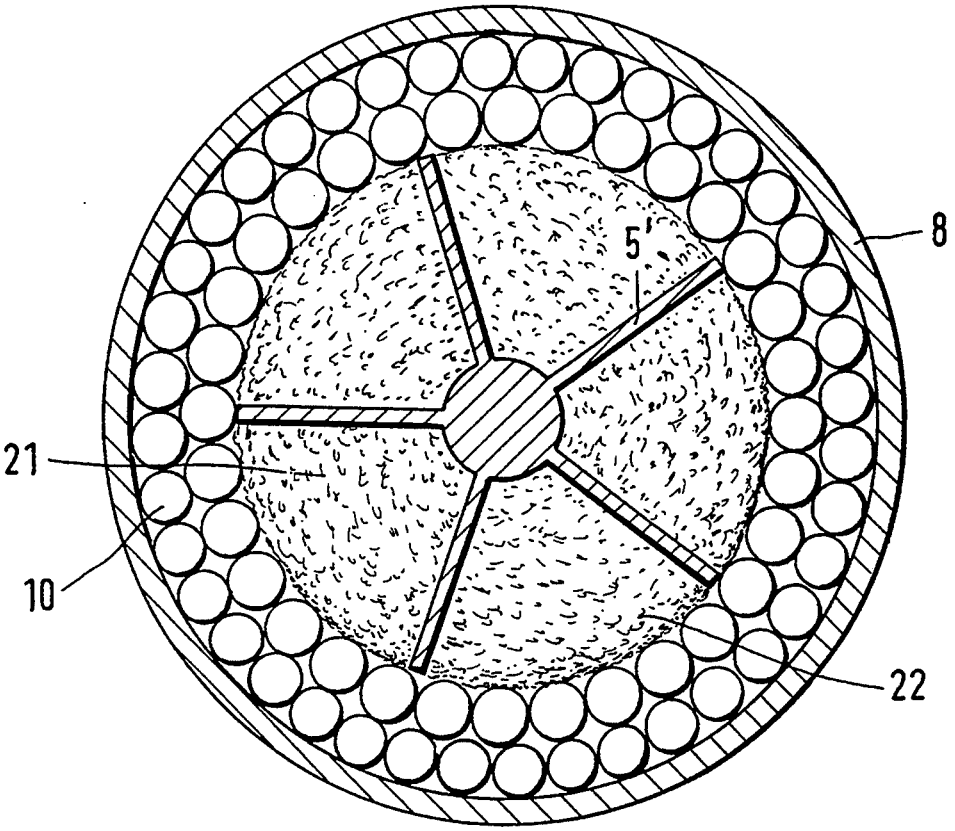
FIG. 2 is a cross sectional view of a kinetic energy projectile ammunition unit according to the invention. This figure shows the case of a modified realization.

The ammunition unit illustrated in FIG. 2 is a modification of the ammunition unit illustrated in FIG. 1. FIG. 2 shows an ammunition unit in a cross sectional view through section 8 of FIG. 1. The powder rods 10 are located in the space between the fin 5' of the projectile 5 and the combustible propelling charge case of the cylindrical section 8. The length of the powder rods 10 is the same as illustrated in FIG. 1. Locating the powder rods in such an arrangement one gets a ring of powder rods surrounding the rear fin component of the projectile. The interior space 21 of this obtained ring of powder rods is filled with bulk propelling charge powder 22. The advantage of this procedure with bulk propelling charge powder is that the interior of the ring of powder rods (including the rear end of the projectile) can be easily filled with a high loading density. Powder rods can be filled in this space only with difficulties then the loading density is decreased.

In addition, bulk propelling charge powder may be shaken or inserted into the region of the section accommodating the powder rods 10 around the tail portion of the projectile and/or into the spaces between the powder rods 10.

The rear ammunition component 2 also includes a combustible propelling charge casing 12 having a cylindrical portion with a diameter corresponding to that of Section 8. This charge casing 12 is held by a metal casing bottom (stub casing) 13 having a central opening into which a bottom igniter 14 has been screwed. Propelling charge casing 12 is filled with propelling charge powder that has been compressed into a compressed member 15. Compressed member 15 is provided with an axial bore to accommodate a combustible ignition tube 16 which is held by the compressed meter 15 in alignment and engagement with the bottom igniter 14 so that the tube 16 is unable to move laterally and accommodates an ignition charge 17 for the compressed member 15. As shown, the tube 16 extends axially along substantially the entire length (height) of the ammunition component 2.

Combustible ignition system in bulk propelling charges used in practice have failed in the past because of a lack of fixation or securing of the ignition components. Loosely attached combustible ignition components could not be secured at all. In composite solutions it is possible that the combustible portion tears off. Due to the fact that the ignition charge is fixed by the compressed powder member 15, it is now possible to employ combustible ignition systems.

The front and rear ammunition components 1 and 2 are separated from one another by a combustible disk 18 which generally forms the bottom of the front component 1. If necessary, a disk or doughnut shaped additional charge 19 may be provided at the bottom of the powder rods 10 so as to support their ignition. A combustible perforated disc 20 may be disposed between the section 9 filled with the bulk propelling charge powder 11 and the section 8 holding the tubular powder 10.

The described configuration ensures a very high charge density (increase in inner ballistic performance) with reliable ignition and firing (and thus also an increase in performance). After a round has been firing, no steel components project over the edge of the casing bottom 13. Only the latter remains since a combustible ignition chain is made possible by fixing the ignition tube 16 by means of the compressed member 15.

Moreover, the desired configuration can be employed with unitary ammunition as generally shown, wherein the parts 7 and 12 are joined, e.g. at 23 in a known manner, to form a unitary combustible propelling charge casing, as well as with two-part ammunition. With two-part ammunition, the separation into two parts is provided in the region of disc 18, e.g. by using the disc 18 to close the bottom of the cylindrical section 8 of the front ammunition component 1.

The invention now being fully described, it will be apparent to one of ordinary skill in the art that any changes and modifications can be made thereto without departing from the spirit or scope of the invention as set forth herein.

What is claimed is:

1. An ammunition unit comprising:

a front ammunition component including a combustible propelling charge casing having a rear cylindrical section and a front inwardly tapering section with a front opening, and a fin stabilized projectile having its rear fin component extending via said opening into said casing to the bottom of said first component; a rear ammunition component having a non-combustible casing bottom with a centrally disposed bottom igniter, a combustible propelling charge casing with a cylindrical section having a diameter corresponding to that of said front component fastened to said casing bottom, and a combustible ignition tube for a propelling charge igniter in operative engagement with said bottom igniter and extending axially essentially over the entire length of said rear ammunition component; a combustible disc separating said front and rear ammunition components; a member of compressed propelling charge powder filling said propelling charge casing of said rear ammunition component and surrounding said ignition tube; rods of propelling charge powder extending longitudinally within and substantially along an entire length of said cylindrical section of said charge casing of said front ammunition component; and bulk propelling charge powder disposed in said inwardly tapering section of said front component in front of said powder rods.

2. An ammunition unit as defined in claim 1, further comprising a supplemental charge disposed adjacent said disc within one of said ammunition components.

3. An ammunition unit as defined in claim 1, wherein said powder rods form a ring surrounding said rear fin component of said projectile; and bulk propelling charge powder is disposed in and substantially filling the interior of said ring adjacent said rear fin component of said projectile.

4. An ammunition unit as defined in claim 3 further comprising bulk propelling charge powder disposed in and substantially filling spaces between said powder rods.

5. An ammunition unit as defined in claim 1 further comprising bulk propelling charge powder disposed in and substantially filling any spaces between said powder rods.

6. An ammunition unit as defined in claim 1 further comprising a combustible perforated disk disposed between said powder rods in said cylindrical section and said bulk propelling charge powder in said tapering section of said front component.

7. An ammunition unit as defined in claim 1 wherein said combustible ignition tube, which is in operative engagement with said bottom igniter, is secured in position in its peripheral region by said compressed powder meter.

8. An ammunition unit as defined in claim 1, wherein said cylindrical sections of said propelling charge casings of said front and rear ammunition components are jointed to form a unitary charge casing.

* * * * *